United States Patent [19]

Greve Hansen et al.

[11] Patent Number: 5,062,346

[45] Date of Patent: Nov. 5, 1991

[54] HEAT PROTECTIVE COVERING FOR A PIPE AND A ROD-SHAPED ARTICLE, ESPECIALLY FOR GUN BARRELS

[75] Inventors: Niels F. Greve Hansen, Jerslev; Jørn H. Greve Hansen, Kalundborg, both of Denmark

[73] Assignee: Dansk Industri Syndikat A/S, Denmark

[21] Appl. No.: 603,713

[22] PCT Filed: May 24, 1989

[86] PCT No.: PCT/DK89/00136

§ 371 Date: Nov. 21, 1990

§ 102(e) Date: Nov. 21, 1990

[87] PCT Pub. No.: WO89/11628

PCT Pub. Date: Nov. 30, 1989

[30] Foreign Application Priority Data

May 25, 1988 [DK] Denmark ..... 2839/88

[51] Int. Cl.[5] ..... F41A 13/12

[52] U.S. Cl. ..... 89/14.1

[58] Field of Search ..... 89/14.1, 16

[56] References Cited

U.S. PATENT DOCUMENTS

| | | | |
|---|---|---|---|
| 2,467,372 | 4/1949 | De Permentier | 89/14.1 |
| 2,935,912 | 5/1960 | Hartley | 89/14.1 |
| 2,965,994 | 12/1960 | Sullivan | 89/14.1 |
| 4,346,643 | 8/1982 | Taylor et al. | 89/14.1 |
| 4,413,668 | 11/1983 | Allard | 165/1 |
| 4,536,982 | 8/1985 | Bredbury et al. | 42/71.01 |
| 4,663,875 | 5/1987 | Tatro | 89/14.1 |
| 4,753,154 | 6/1988 | Higashi | 89/14.1 |
| 4,762,048 | 8/1988 | Higashi | 89/14.1 |
| 4,982,648 | 1/1991 | Bol et al. | 89/14.1 |

*Primary Examiner*—David H. Brown

*Attorney, Agent, or Firm*—Larson and Taylor

[57] ABSTRACT

The heat protective covering comprises at least two concentric and cylindrical plate layers (6, 7) fixedly mounted round for instance a gun barrel (1). Rows of holes (12, 13, 14, 15) are shaped along and in, respectively, the upper and lower lines of generatrix of each plate layer (6, 7). The heat protective covering ensures that the bore or the central axis of for instance the gun is completely parallel to the line of sight irrespective of wind and weather from one side, such as a strong sunlight, wind or a heavy shower from one side.

9 Claims, 1 Drawing Sheet

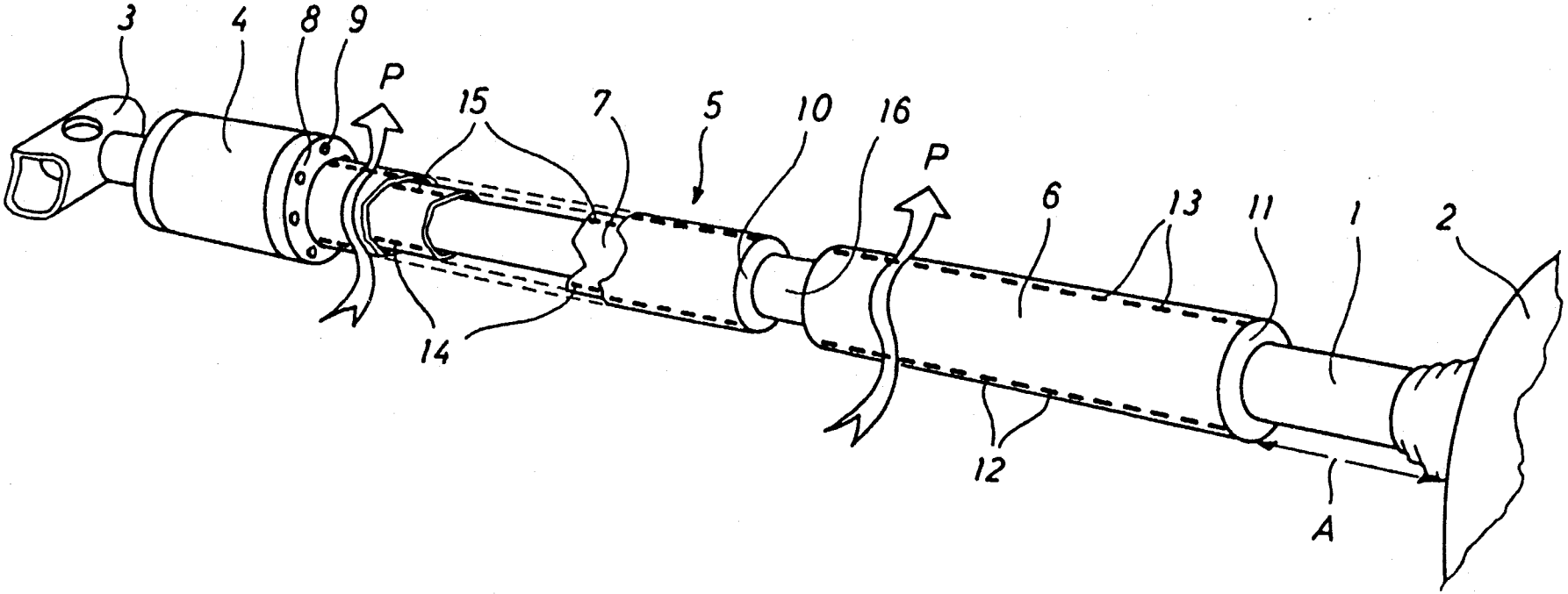
2
1
A
11
13
6
12
P
16
10
5
7
15
14
P
9
8
4
3

HEAT PROTECTIVE COVERING FOR A PIPE AND A ROD-SHAPED ARTICLE, ESPECIALLY FOR GUN BARRELS

TECHNICAL FIELD

The present invention relates to a heat protective covering for a pipe and a rod-shaped article, especially for gun barrels.

BACKGROUND ART

It is known in connection with machine guns to surround the barrel with a covering filled with water so as to keep the temperature of the barrel as low as possible during the firing, and thereby to obtain a maximum period of continuous firing. It is furthermore known from the "Madsen" gun developed at the turn of the century by the Danish inventor Madsen to provide the barrel with ribs allowing an air cooling thereof, and to surround the barrel with a protective covering comprising large open holes. The holes both ensure a sufficient supply of air to the barrel from all sides and prevent the men from touching the hot barrel after the firing. Such coverings have previously only been used for small calibre weapons.

It has turned out in connection with large guns, such as for instance guns of a calibre of 40–120 mm or more where the gun is mounted in the gun turret of a tank, or in connection with anti-tank guns and ship guns for direct firing, that the effects on the gun barrel of sun, wind and rain from one side cause an undesired deflection reducing the accuracy of the gun, especially when firing the decisive first shot. In connection with a gun barrel of a length of about 3 m the deflection can be as much as about 3 mm, which deviates from the line of sight to such an extent that the possibility of a hit in the first decisive shot revealing the position of the gun is considerably reduced.

The German Offenlegungsschrift No. 36,39,866 discloses a gun barrel provided on the outer wall with a cooling duct. The cooling duct comprises a helical groove shaped in and on, respectively, the outer surface of the barrel, and furthermore a thin pipe pushed on said gun barrel and closing the grooves to form the ducts. A for instance bellow-shaped air distribution chamber is provided adjacent the chamber end, said distribution chamber blowing air from a blower through the ducts open at the muzzle end. A heat-insulating layer is provided between the gun barrel and the thin pipe. Such a structure is relatively expensive and complicated, and unless the blower is operating continuously, such a gun barrel is still subjected to deflection by the temperature effects from one side. In addition both the blower and the distribution chamber are subjected to shock effects which involves a high risk of malfunctioning.

German Offenlegungsschrift No. 1,918,422 discloses a gun barrel surrounded by a metal casing, which is situated at a short distance from the outer surface of the gun barrel. The still air between the barrel and the casing serves as heat insulation. Such as solution is, however, not very good because when the gun barrel is subjected to temperature effects from one side for a long time, said gun barrel will have a tendency to deflect.

DISCLOSURE OF INVENTION

The object of the present invention is to provide a simple and sturdy heat protective covering protecting the pipe or the rod-shaped article against the temperature effects of inter alia sun, wind, and rain from one side, as well as to ensure that the deviation of for instance a gun barrel from the line of sight, especially in connection with the first shot, is reduced to a minimum, and preferably to zero.

The heat protective covering according to the invention is based on the principle of natural convection for removing the left heat. Heat coming from the outside causes a heating of the air surrounding the plate layers. The heated air tries to escape through the holes in the top side of the plate layers simultaneous with fresh and cooler air being drawn in at the bottom through the lower row of holes. As a result, a uniform temperature is maintained at the gun barrel.

The heat protective covering is in addition important for a uniform emission of the heat from the gun heated by the shooting, said covering eliminating the effect of wind and weather conditions. After the firing, the air passing through the spaces between the plate layers has in addition the effect that the outer plate layer has a considerably lower temperature than the gun barrel. In this manner it is possible—especially when more than two cylindrical plate layers are involved—to reduce the thermal infra-red signal emitted by the gun barrel heated by the firing to such a degree that the signal detected by a thermal infra-red detector is considerably reduced.

BRIEF DESCRIPTION OF DRAWING

Additional advantages appear from the following explanation with reference to the accompanying drawing, which is a perspective view of the gun barrel of a tank, where the heat protective covering according to the invention is mounted on said barrel, and where some members have been omitted for the sake of clarity.

BEST MODE FOR CARRYING OUT THE INVENTION

The FIGURE illustrates a gun barrel 1 mounted in a gun turret 2, which for instance is mounted on a tank, a ship, another means of transportation or stationarily. The gun barrel can for instance also be mounted on a tank carriage. The muzzle of the gun barrel is provided with a muzzle brake 3 and a smoke bonnet 4.

A heat protective covering 5 according to the invention is concentricly mounted round the gun barrel 1. The heat protective covering comprises at least one outer cylindrical plate layer 6 and an inner cylindrical plate layer 7. One or more cylindrical intermediary layers similar to the plate layers can optionally be inserted.

The outer and inner layers 6, 7 and possible intermediary layers are permanently secured, such as welded, to an annular plate 8 at the muzzle end. The annular plate 8 is secured to the smoke bonnet 4 by means of a plurality, such as eight, of threaded means, such as set screws 9. The screws extend through a corresponding number of holes (not shown) in the annular plate and are screwed into correspondingly threaded holes (not shown) cut in the washer of the smoke bonnet.

If no smoke bonnet is provided on the gun barrel, the heat protective covering 5 can for instance be secured to the muzzle brake of the gun barrel or the muzzle surface of said gun barrel.

The outer and inner layers 6, 7 and possible intermediary layers are interconnected at regular intervals by means of spacer rings 10, 11 of an inner diameter corresponding to the diameter of the gun barrel 1 on the location in question. The space between the gun barrel 1 and the inner cylindrical plate layer 7 is relatively small with the effect that the air in said space has only an insignificant tendency to ascend when heated. The space between the inner and the outer plate layer 7 and 6, respectively, is somewhat larger with the effect that the air has a strong tendency to ascend when heated in the direction towards the arrows P. The rearmost spacer ring 11 is a washer ending the heat protective covering 5 at a distance A from the gun turret 2 or the protective shield, respectively, of a gun carriage not shown. The distance A is at least equal to and preferably slightly larger than the largest recoil length of the gun barrel 1 in order to prevent upsetting and deformation of the heat protective covering during firing.

A row of holes 12 and 14, respectively, extend along the two sides of the lower line of generatrix of both the outer and the inner cylindrical plate layer as well as of possible intermediary layers, of the drawing. The rows of holes are preferably displaced relative to one another. The two rows can, however, in a simplified embodiment be replaced by only one lower row of holes with the centres located on the lower line of generatrix. A corresponding row of holes 13 and 15, respectively, extend along the upper line of generatrix of each cylindrical plate layer 6, 7 and possible intermediary layers. The latter row of holes can also be replaced by a double row of holes displaced relative to one another.

The holes 14, 15 of the inner plate layers are displaced relative to the holes 12, 13 in the outer plate layer, which prevents direct effects from the outside of for instance sun or wind on the barrel.

Instead of only one or two lower and upper rows of holes it is also possible to use three or more upper and lower rows of holes extending in parallel. It is, however, essential that the above rows are situated relatively close to the lower and upper, respectively, line of generatrix of the gun barrel. Under all circumstances the rows of holes must be shaped so as to create an upward air current substantially surrounding the gun barrel 1.

All the cylindrical plate layers and spacer rings are made of stainless steel. At the mounting the entire protective covering is inserted as a unit over the gun barrel whereafter it is secured in the smoke bonnet.

The heat protective covering according to the inveniton counteracts the effects on the gun barrel of sun, wind, and rain from one side. Without the heat protective covering, the barrel would be subjected to undesired deflection effects reducing the accuracy of the gun. In connection with a 3 m long gun barrel exposed to heat from one side, a deflection of 3 mm has been measured at the muzzle end, which represents a substantial deviation from the line of sight. When exposed to heat from the outside, the air surrounded by the plate layers is heated. The heated air will try to escape through the holes in the top side of the covering simultaneous with fresh and cooler air being drawn in at the bottom. In this manner a uniform temperature is maintained over the entire outer surface of the gun barrel. The effect of the covering is thus based on the principle of natural convection for removing the heat left from one side.

The displacing of the holes 14, 15 in the inner plate layer relative to the holes 12, 13 in the outer plate layer prevents a direct affecting of the barrel from the outside.

The heat protective covering is in addition important for a uniform emission of the heat from the gun heated by the firing, said covering eliminating the effect of wind and weather on the gun barrel.

The covering ensures furthermore that the gun barrel heated after a firing is cooled faster as compared to previous guns, and that in particular the outer layer 6 is substantially colder than the gun barrel due to the insulating layers of air and the air passing through the spaces. As a result the thermal emission of heat is highly reduced with the effect that the signal of the gun barrel on a thermal infra-red detector is substantially weakened.

The heat protective covering shown in the drawing is suited for a gun barrel comprising in the middle of its length a so-called locking device for transportation. The illustrated heat protective covering comprises a contraction at the location of the locking device for transportation. At the contraction, the spacer ring 10 ending the front portion of the covering is fixedly connected to a short tube 16. The short tube is in turn fixedly connected to a corresponding spacer ring situated in front on the rear portion of the covering. It is obvious that when the gun barrel is provided with a smooth outer surface, the covering extends without contractions from the muzzle end to the washer 11. It is also obvious that the heat protective covering can be slightly tapered towards the muzzle end when the gun barrel is slightly conical, and that the heat protective covering can be adapted in other ways to various gun barrels.

Though the above heat protective covering 5 has been described in connection with a gun barrel, it is obvious that the heat protective covering according to the invention can also be used for other pipes and rod-shaped articles, where it is of importance that said pipes and rod-shaped articles maintain their rectilinearity when exposed to temperature effects from one side. It is also possible to make the covering of other materials than stainless steel, e.g. of aluminium or plastics, depending on the expected use.

We claim:

1. A heat protective covering for gun barrels of a calibre of 40 to 120 mm, characterized in that the heat protective covering comprises at least two concentric and cylindrical plate layers, which are fixedly mounted at regular intervals around and at a distance from the barrel, and that at least one row of holes is formed at most a short distance in the circumferential direction thereof from and parallel to the upper and the lower line of generatrix, respectively, of each plate layer.

2. A heat protective covering as claimed in claim 1, characterized in that the holes in the outer plate layer are displaced relative to the adjacent holes of the inner plate layer.

3. A heat protective covering as claimed in claim 1, characterized in that the plate layers and the spacer rings are made of stainless steel.

4. A heat protective covering as claimed in claim 1, characterized in that at least two similar plate layers are fixedly mounted to the outermost portion of the gun barrel and to a means, respectively, fixedly mounted thereon.

5. A heat protective covering as claimed in claim 4, characterized in that the means is the closer one of a smoke bonnet and a muzzle brake of the gun barrel, that each of the at least two cylindrical plate layers are permanently connected to an annular plate at the end adjacent the muzzle of the gun barrel, and that the annular plate is secured to the means by a plurality of threaded members extending through holes drilled in the annular plate and screwed fixedly into correspondingly threaded holes.

6. A heat protective covering as claimed in claim 1, characterized in that the at least two cylindrical plate layers are interconnected at regular intervals by spacer rings abutting the outer surface of the barrel, respectively, by the inner annular rim of the spacer rings.

7. A heat protective covering as claimed in claim 6, characterized in that the spacer rings are sized to keep the at least two plate layers uniformly spaced from one another and from the outer surface of the gun barrel, respectively.

8. A heat protective covering as claimed in claim 6, characterized in that the gun barrel is mounted in a gun turret and the spacer ring adjacent the chamber end of the gun barrel is a washer ending the heat protective covering at a predetermined distance from an outer side of the gun turret and from a protective shield of a gun carriage, respectively.

9. A heat protective covering as claimed in claim 8, characterized in that the distance is at least equal to, and preferably slightly larger than a maximum recoil length of the gun barrel.

* * * * *